United States Patent [19]

Scheinecker et al.

[11] 4,000,840

[45] Jan. 4, 1977

[54] TUNDISH CAR AND ROTARY SUPPORT FOR POSITIONING TUNDISH

[75] Inventors: Alois Scheinecker; Stefan Biricz, both of Linz, Austria

[73] Assignee: Vereinigte Osterreichische Eisen- und Stahlwerke - Alpine Montan Aktiengesellschaft, Linz, Austria

[22] Filed: Aug. 21, 1975

[21] Appl. No.: 606,564

[30] Foreign Application Priority Data

Aug. 30, 1974 Austria ..... 7026/74

[52] U.S. Cl. ..... 222/607; 164/337; 222/168

[51] Int. Cl.[2] ..... B22D 41/12

[58] Field of Search ..... 164/281, 335, 337; 222/160, 166, 168, 168.5, DIG. 23, 607

[56] References Cited

UNITED STATES PATENTS

| | | | |
|---|---|---|---|
| 3,344,847 | 10/1967 | Beemer | 164/281 |
| 3,552,902 | 1/1971 | Schoffmann et al. | 164/281 |
| 3,773,228 | 11/1973 | Koch et al. | 222/168 |
| 3,817,318 | 6/1974 | Greenberger et al. | 164/281 |
| 3,820,769 | 6/1974 | Kishi et al. | 164/281 X |
| 3,894,576 | 7/1975 | Schöffmann | 222/168 X |

*Primary Examiner*—Robert B. Reeves
*Assistant Examiner*—David A. Scherbel
*Attorney, Agent, or Firm*—Brumbaugh, Graves, Donohue & Raymond

[57] ABSTRACT

A continuous casting plant has at least one tundish car movable on a circular arc-shaped pathway. The tundish car is pivotable around a column, centered in the horizontal direction by means of three guiding rollers and secured against tilting in the vertical direction by two vertical supporting rollers. When two cars are used, one of the cars has a cranked longitudinal carrier. The column can be hollow and surround the ladle stand, and it can be vertically separated into two parts.

4 Claims, 2 Drawing Figures

TUNDISH CAR AND ROTARY SUPPORT FOR POSITIONING TUNDISH

BACKGROUND OF THE INVENTION

The invention relates to a continuous casting plant with one or more tundish cars which are movable on a circular arc-shaped pathway by means of supporting or driving rollers.

In plants for the continuous casting of strands, at least two receiving means with one tundish each are necessary. Each receiving means is movable from a reserve position into a casting position and vice versa.

In their reserve positions the tundishes are charged with molten steel from a pouring ladle. In the casting position the steel is cast into the mould via a casting tube or snorkel, that is, inserted into the bottom of the tundish. It is especially important that the casting tube be in a precicely defined vertical position relative to the continuous casting mould and retain this position during the whole casting procedure. Only the height of the tundish and thus also of the casting tube is variable by means of an altitude-adjusting means, in order to allow for a change in the kinetic energy of the casting stream, if necessary.

If, during casting, the vertical position of the casting tube or snorkel changes due to a yielding of the receiving means or the supporting structure thereof, then the direction of the casting stream is also changed, which can cause the strand skin of the cast product to become uneven or even to break.

Therefore it is important to create a continuous casting plant with one or more tundish cars in which the tundishes are reliably and accurately guided during continuous operation and under changing loads and heat influences, and in which the casting tubes or snorkels, of the tundishes are accurately positioned. Furthermore the plant should be easily accessible, and the machine parts should be quickly and easily exchangeable.

Known plants with one or more tundish cars that are guided on circular arc-shaped rails do not, or do not fully, meet these demands.

U.S. Pat. No. 3,344,847, e.g., describes a device in which each tundish receiving means is guided on a circular arc-shaped pathway over a total of six running rollers. The tundish is arranged on a projecting arm. This has the disadvantage that, due to the projecting load, extremely high wheel pressures occur and complicated and expensive bearings are necessary. Moreover, the circular arc-shaped pathway carrier, which on three sides is passable by the running rollers of the tundish receiving means, is expensive and cannot be constructed rigidly enough to exclude elastic deformations; thus an accurate guiding of the tundish is not possible.

From German Pat. No. 1,963,147 a mounting of tundish launders on a roundabout arrangement for pouring ladles in continuous casting plants is known. With this apparatus a stationary center column carries pivotable arms for the ladles and also for the tundish launders, which are moveable independently of the former. The pivotable arms are connected with the tundish launders via parallel guide rods. An altitude adjustment of the tundish launders can be effected by a hydraulic piston gearing which is supported upon the respective pivotable arm and engages the parallel guide rods. For supporting the load of the tundish launders and the useful load, as well as the weight of the parallel guide rods and the piston gearing, and annular face is provided on the center column which is formed as a rail and on which a wheel rolls. This wheel is supported in the respective pivotable arm. Also in this construction, due to the unfavorably high lever ratio of the work arm to the power arm, very high wheel pressures and bearing forces arise, which lead to a fast wear and to deviations of the tundish position and require frequent readjustments.

SUMMARY OF THE INVENTION

The invention aims at preventing the above described disadvantages and difficulties by creating a continuous casting plant with one or more tundish cars which are movable on a circular arc-shaped pathway by means of supporting or driving rollers and which meets all of the demands of casting and constitutes a simple, operationally safe, and economical construction.

The invention consists in that the car or cars are rotatably mounted on a column and are centered in the horizontal direction relative to this column by three guiding rollers symmetrically arranged around the periphery of the column and are secured against tilting in vertical direction by two vertical supporting rollers running between guiding rims or shoulders of the column.

Advantageously, the column is hollow so that a further column, i.e. the ladle stand column, can be guided through the former. Thus the centers of rotation of the pouring ladle carrying arms and the tundish cars coincide. If — according to a preferred embodiment — the hollow tundish car column and the ladle stand column are independent of each other and each one is connected to the platform or the base, the tundish car means will remain operative even when the ladle stand column is damaged or taken out of service, and emergency operation of the continuous casting plant can be maintained by charging the tundishes from a pouring ladle hanging in a crane.

According to a further characteristic of the invention the column can consist of two parts, the parting line extending vertically. The two half-tube-shaped halves can be connected by screws or the like.

A further embodiment of the invention consists in that, when two cars are used, the longitudinal carriers of one car are cranked. Thus a compact and uniform configuration of the plant is achieved.

For a secure guiding of the tundish car or cars, it is suitable that at the front part of the tundish car two further vertical supporting rollers are arranged which are supported on a circular arc-shaped railpath which is concentric with the column axis.

BRIEF DESCRIPTION OF THE DRAWINGS

The invention shall now be described by way of an example and with reference to the accompanying drawings wherein FIG. 1 is a top view of a tundish-receiving means, while

DESCRIPTION OF A PREFERRED EMBODIMENT

Figure 2:
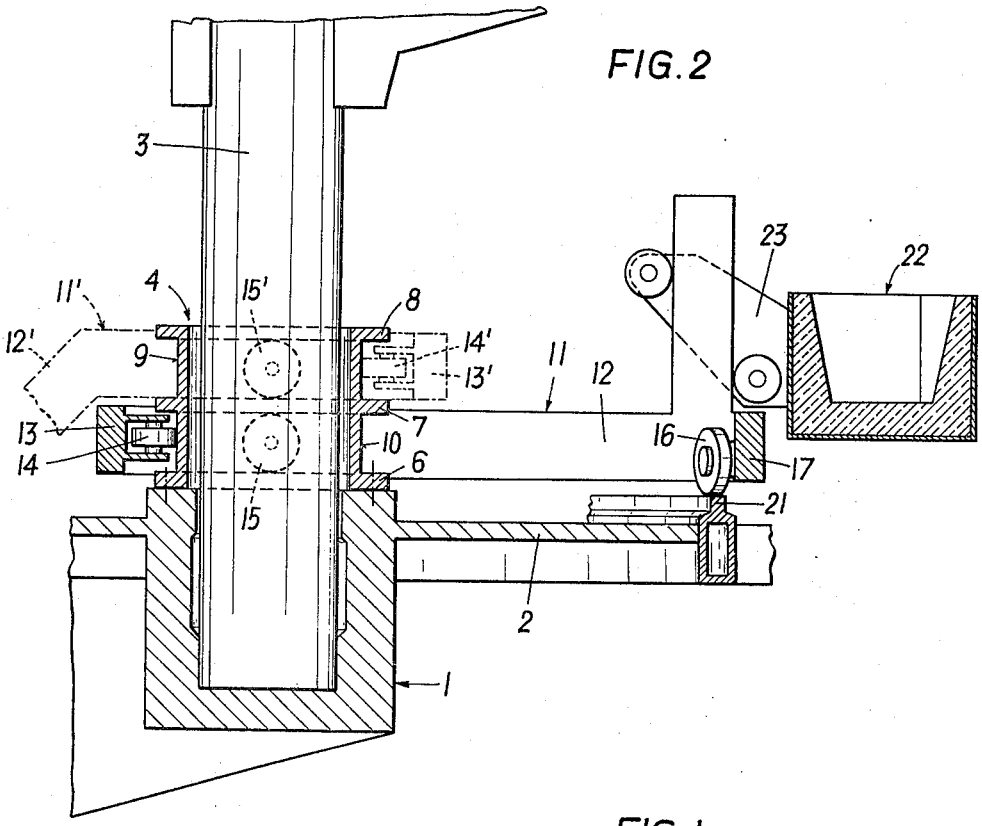
FIG. 2 is a section along line II-II of FIG. 1.
Figure 1:
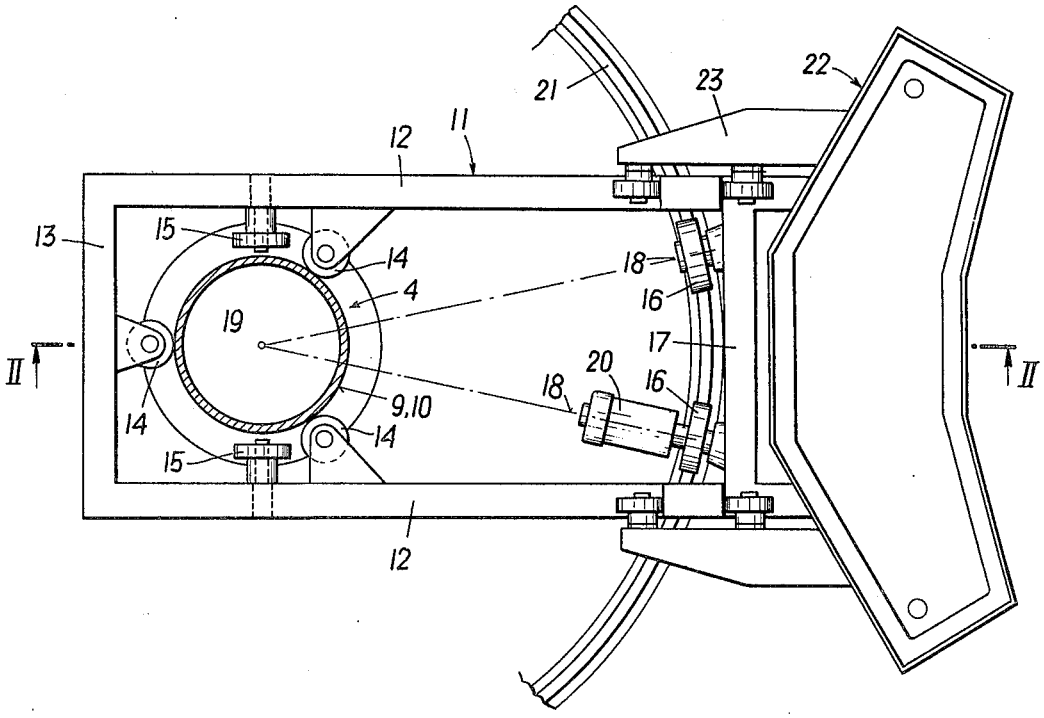

In a casting platform 2 a bushing 1 is mounted. In the bushing a column 3 of a ladle stand is rotatably arranged. With the help of the ladle stand, and in a manner known per se, ladles are brought from a receiving position into a position in which the tundishes can be charged with molten steel.

On the bushing 1 a hollow rotatable column 4, which surrounds the ladle stand column 3, is secured. Flanges or guiding rims 6, 7 and 8 of the rotatable column 4 extend radially from the cylinder faces 9 and 10 of the rotatable column.

The tundish car, which is generally denoted with 11, has two longitudinal carriers 12 and a rear transverse carrier 13. According to the invention, on the two longitudinal carriers and on the transverse carrier three guiding rollers 14 are mounted offset by 120° relative to one another for guidance in the horizontal direction, which rollers roll on the cylinder face 10 of the rotatable column (FIG. 2). Furthermore, in the two longitudinal carriers 12 and opposite each other, two supporting rollers 15 are mounted so as to engage rotatable column 4 between the shoulders 6 and 7 and secure the car against tilting in vertical direction.

At a front transverse carrier 17, which connects the longitudinal carriers 12 of the tundish car 11, supporting rollers 16 are mounted so that their axes 18 are directed towards the center of rotation 19. These supporting rollers are driven by a driving motor 20 and roll on the railpath 21 which is concentric with the center of rotation 19. The tundish car carries the tundish 22 via a console-like roller-guided carrying structure 23 which can be moved up and down.

In FIG. 2 a second tundish car 11′ is outlined in dot-and-dash lines. This car 11′ is guided in the same way as described above for car 11′ except that it is guided on the cylinder face 9 of the rotatable column 4 by means of rollers 14′ in horizontal direction and by means of supporting rollers 15′ in vertical direction. The rollers 15′ engage rotatable column 4 between the shoulders 7 and 8 of the rotatable column 4. By driving the supporting rollers 16 by means of the motor 20, the tundish car or cars can be pivoted around the center of rotation 19.

Furthermore it can be seen from FIG. 2 that the longitudinal carriers 12′ of the car 11′ have a crank-like shape so that each one of the cars separately can be moved without mutual interference.

The construction according to the invention has the advantage that the rotatable mounting of the cars on the column consists make use of simple machine parts which are not susceptible to faults and that, due to the interaction of the guiding and supporting wheels, a precise guiding of the cars is achieved. Due to the favorable lever-ratio of the work arm to the supporting arm, the total pressure on the front supporting wheels is only slightly more than the weight of the tundish together with the useful load, i.e. the molten metal, and therefore the circular arc-shaped pathway can be comparatively lightly built. A further advantage of the plant according to the invention consists in that the tundish cars can be operated independent of the ladle stand and remain operable even if the latter is out of order.

What we claim is:

1. In a continuous casting plant with at least one tundish car carrying a tundish at one end and movable on a generally horizontal circular arc-shaped pathway by means of rollers attached to the tundish car adjacent the tundish and supported on top of the pathway, the improvement comprising:

a generally vertical stationary column concentric with the pathway and rotatably supporting the tundish car, said column having at least two flanges extending radially from the exterior of the cylinder to form a guide path;

three guiding rollers attached to the tundish car and symmetrically arranged about the periphery of the column to run on the cylinder face between the flanges of the guide path so as to provide centering of the tundish car relative to the column; and two supporting rollers attached to the tundish car and arranged to run in the guide path on at least one of the flanges in order to secure the tundish car against tilting.

2. A continuous casting plant as set forth in claim 1, wherein said column is hollow.

3. A continuous casting plant as set forth in claim 1 with two tundish cars, wherein each car has two longitudinal carriers and two transverse carriers and wherein the longitudinal carriers of one of said tundish cars have a crank-shape.

4. A continuous casting plant including a tundish, a column arranged in a generally vertical direction and having at least two flanges extending radially from the exterior of the cylinder to form a guide path, a circular arc-shaped railpath concentric with the column, and at least one tundish car supported by said column for supporting the tundish, said tundish car comprising:

two longitudinal carriers, a rear transverse carrier on the opposite side of the column from the tundish and a front transverse carrier adjacent the tundish;

three guiding rollers connected to the two longitudinal carriers and the rear transverse carrier and symmetrically arranged about the periphery of the column to run on the cylinder between the flanges of the guide path so as to provide for centering of the tundish car relative to the column;

two first supporting rollers connected to the two longitudinal carriers and running in the guide path on at least one of the flanges in order to secure the tundish car against tilting; and two second supporting rollers arranged on the front transverse carrier and supported on top of the circular arc-shaped railpath for movement thereon.

* * * * *